US012636539B2

(12) United States Patent
Park et al.

(10) Patent No.: US 12,636,539 B2
(45) Date of Patent: May 26, 2026

(54) WEARABLE FITNESS APPARATUS USING ELASTIC CABLE

(71) Applicant: Samsung Electronics Co., Ltd., Suwon-si (KR)

(72) Inventors: Junghoon Park, Suwon-si (KR); Sungchan Ko, Suwon-si (KR); Donghyun Kim, Suwon-si (KR); Minhyung Lee, Suwon-si (KR); Yongtae Kim, Suwon-si (KR); Jaehong Kim, Suwon-si (KR); Maria Noh, Suwon-si (KR); Keehong Seo, Suwon-si (KR); Kyoungwoon Hahm, Suwon-si (KR); Seungyong Hyung, Suwon-si (KR); Jungsik Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 191 days.

(21) Appl. No.: 18/412,225

(22) Filed: Jan. 12, 2024

(65) Prior Publication Data

US 2024/0149102 A1 May 9, 2024

Related U.S. Application Data

(63) Continuation of application No. PCT/KR2023/012597, filed on Aug. 24, 2023.

(30) Foreign Application Priority Data

Aug. 29, 2022 (KR) ..... 10-2022-0108088
Sep. 13, 2022 (KR) ..... 10-2022-0115108
Nov. 1, 2022 (KR) ..... 10-2022-0143903

(51) Int. Cl.
*A63B 21/00* (2006.01)
*A63B 21/005* (2006.01)
(Continued)

(52) U.S. Cl.
CPC ..... *A63B 21/4007* (2015.10); *A63B 21/0058* (2013.01); *A63B 21/0442* (2013.01);
(Continued)

(58) Field of Classification Search
CPC ..... A63B 21/4007; A63B 2024/0071
See application file for complete search history.

(56) References Cited

U.S. PATENT DOCUMENTS 9,320,936 B1 * 4/2016 Rea ..... A63B 23/1209
10,286,249 B1 5/2019 Sibhatu
(Continued)

FOREIGN PATENT DOCUMENTS

KR 20150077413 A 7/2015
KR 101646914 B1 8/2016
(Continued)

OTHER PUBLICATIONS

Stephen P. Bird, et al., "Designing Resistance Training Programmes to Enhance Muscular Fitness", Sports Med, vol. 35, No. 10, 2005, pp. 841-851 (11 pages).
(Continued)

*Primary Examiner* — Joshua T Kennedy
(74) *Attorney, Agent, or Firm* — Nixon & Vanderhye P.C.

(57) ABSTRACT

A wearable fitness/exercise/assistance apparatus using at least an elastic cable. The wearable apparatus may include a base plate to be worn on the back of a user, a wearing band connected to the base plate, a driving module including a module case provided to the base plate to be detachable, a motor disposed inside the module case, an inelastic cable connected to the motor, and an elastic cable connected to the inelastic cable, and a wearing part to be worn on the body of the user and connected to the elastic cable, wherein the
(Continued)

elastic cable may have a length that changes when the inelastic cable is moved by the motor. In addition, various embodiments are possible.

14 Claims, 17 Drawing Sheets

(51) Int. Cl.
*A63B 21/04* (2006.01)
*A63B 21/055* (2006.01)
*A63B 24/00* (2006.01)

(52) U.S. Cl.
CPC ..... *A63B 21/0552* (2013.01); *A63B 21/153* (2013.01); *A63B 24/0062* (2013.01); *A63B 2024/0093* (2013.01); *A63B 2220/50* (2013.01); *A63B 2225/09* (2013.01); *A63B 2230/06* (2013.01)

(56) References Cited

U.S. PATENT DOCUMENTS

| | | | | |
|---|---|---|---|---|
| 10,456,614 | B1 * | 10/2019 | Dube | A63B 24/0062 |
| 10,878,952 | B1 * | 12/2020 | Patel | G06K 7/10297 |
| 2015/0011368 | A1 | 1/2015 | Manor | |
| 2017/0100626 | A1 * | 4/2017 | Ko | A63B 21/154 |
| 2017/0266477 | A1 | 9/2017 | Cordero | |
| 2017/0368413 | A1 * | 12/2017 | Shavit | A63B 24/0075 |
| 2018/0021616 | A1 * | 1/2018 | Orady | A63B 21/16 482/5 |
| 2018/0056104 | A1 * | 3/2018 | Cromie | A61H 3/00 |
| 2019/0134454 | A1 * | 5/2019 | Mahoney | A63F 13/24 |
| 2019/0175975 | A1 * | 6/2019 | Carriere | A63B 21/4043 |
| 2020/0155891 | A1 * | 5/2020 | Tedesco | A63B 21/4025 |
| 2021/0244992 | A1 | 8/2021 | Lear | |
| 2022/0072381 | A1 * | 3/2022 | Trehan | G10L 15/18 |

FOREIGN PATENT DOCUMENTS

| | | | | |
|---|---|---|---|---|
| KR | 20170041537 A | | 4/2017 | |
| KR | 20200059811 A | * | 5/2020 | A63B 21/0052 |
| WO | WO-2014109799 A1 | * | 7/2014 | F03G 5/062 |
| WO | 2016129716 A1 | | 8/2016 | |

OTHER PUBLICATIONS

"Designing resistance training programs", 4th ed., date unknown, 1 page.

D. Travis McMaster, et al., "Forms of Variable Resistance Training", Strength and Conditioning Journal, vol. 31, No. 1, Feb. 2009, pp. 50-64 (15 pages).

* cited by examiner

WEARABLE FITNESS APPARATUS USING ELASTIC CABLE

CROSS-REFERENCE TO RELATED APPLICATIONS

This application is a continuation application of International Application No. PCT/KR2023/012597 designating the United States, filed on Aug. 24, 2023, in the Korean Intellectual Property Receiving Office and claiming priority to Korean Patent Application No. 10-2022-0108088 filed on Aug. 29, 2022, Korean Patent Application No. 10-2022-0115108 filed on Sep. 13, 2022, and Korean Patent Application No. 10-2022-0143903 filed on Nov. 1, 2022, in the Korean Intellectual Property Office, the entire disclosures of which are all hereby incorporated herein by reference for all purposes.

BACKGROUND

1. Field

One or more example embodiments relate to a wearable fitness apparatus using an elastic cable.

2. Description of Related Art

A fitness apparatus to improve muscular strength of a user is being developed. In accordance with needs of a user, a fitness apparatus that may apply an appropriate stimulus is required.

The above description has been possessed or acquired by the inventor(s) in the course of conceiving the present disclosure and is not necessarily an art publicly known before the present application is filed.

SUMMARY

According to an example aspect, there may be provided a wearable fitness apparatus using an elastic cable including a base plate to be worn on the back of a user, a wearing band connected, directly or indirectly, to the base plate, a driving module including a module case provided to the base plate to be detachable, a motor disposed inside the module case, an inelastic cable connected, directly or indirectly, to the motor, an elastic cable connected, directly or indirectly, to the inelastic cable, and a wearing part to be worn on the body of the user and connected, directly or indirectly, to the elastic cable, wherein the elastic cable has a length that changes when the inelastic cable is moved by the motor.

BRIEF DESCRIPTION OF THE DRAWINGS

These and/or other aspects, features, and advantages will become apparent and more readily appreciated from the following description of example embodiments, taken in conjunction with the accompanying drawings of which.

DETAILED DESCRIPTION

Figure 1:
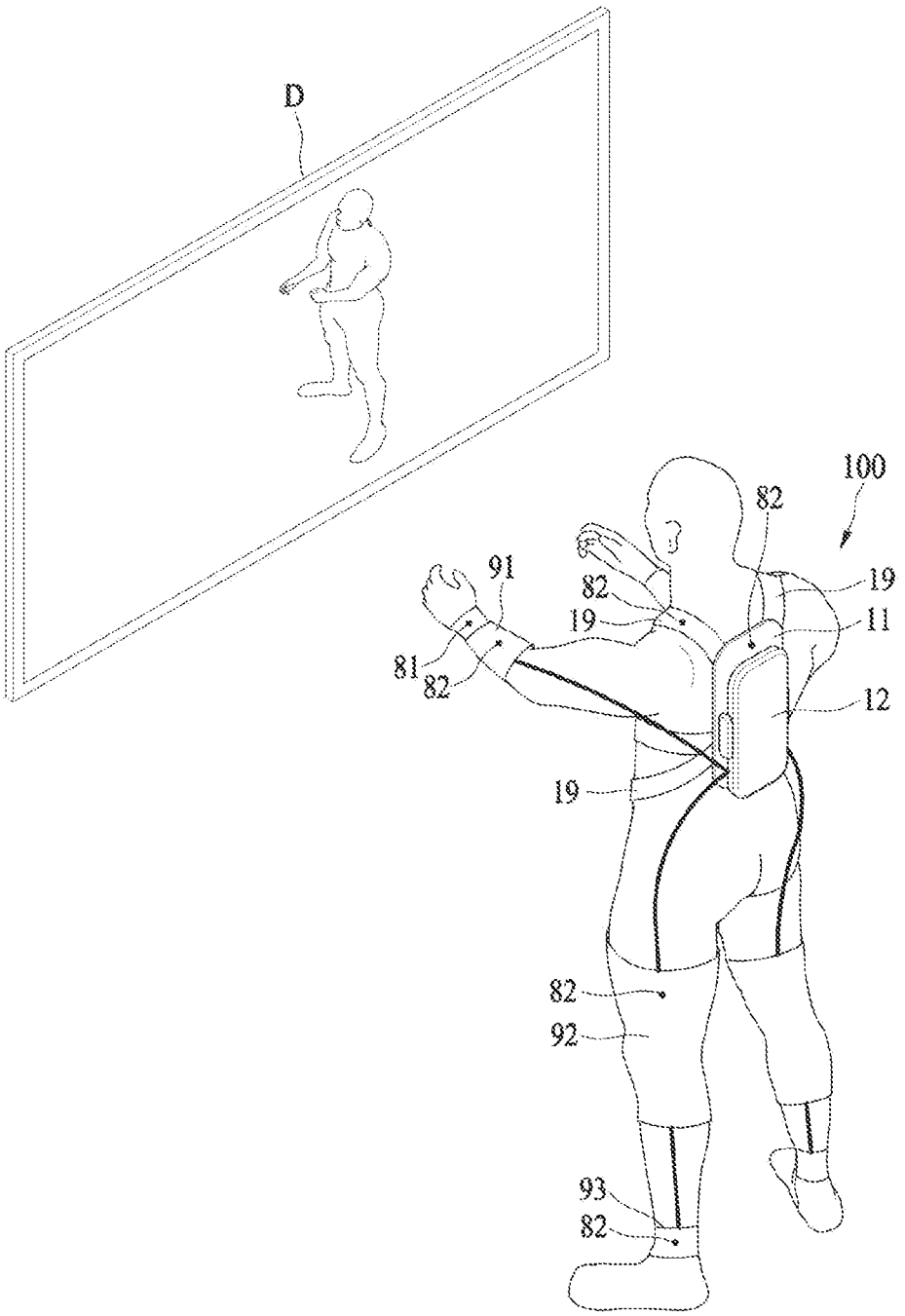
FIG. 1 is a perspective view illustrating a user wearing a wearable fitness apparatus according to an example embodiment.

The following detailed structural or functional description is provided as an example only and various alterations and modifications may be made to examples. Accordingly, the embodiments are not construed as limited to the disclosure and should be understood to include all changes, equivalents, and replacements within the idea and the technical scope of the disclosure.

Terms, such as first, second, and the like, may be used herein to describe various components. Each of these terminologies is not used to define an essence, order or sequence of a corresponding component but used merely to distinguish the corresponding component from other component(s). For example, a "first" component may be referred to as a "second" component, and similarly, the "second" component may be referred to as the "first" component.

It should be noted that if it is described that one component is "connected", "coupled", or "joined" to another component, at least a third component(s) may be "connected", "coupled", and "joined" between the first and second components, although the first component may be directly connected, coupled, or joined to the second component.

The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or populations thereof.

The same name may be used to describe an element included in the embodiments described above and an element having a common function. Unless otherwise mentioned, the descriptions of the embodiments may be applicable to the following embodiments and thus, duplicated descriptions will be omitted for conciseness.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, the examples will be described in detail with reference to the accompanying drawings. When describing the embodiments with reference to the accompanying drawings, like reference numerals refer to like components and a repeated description related thereto will be omitted.

Figure 2:
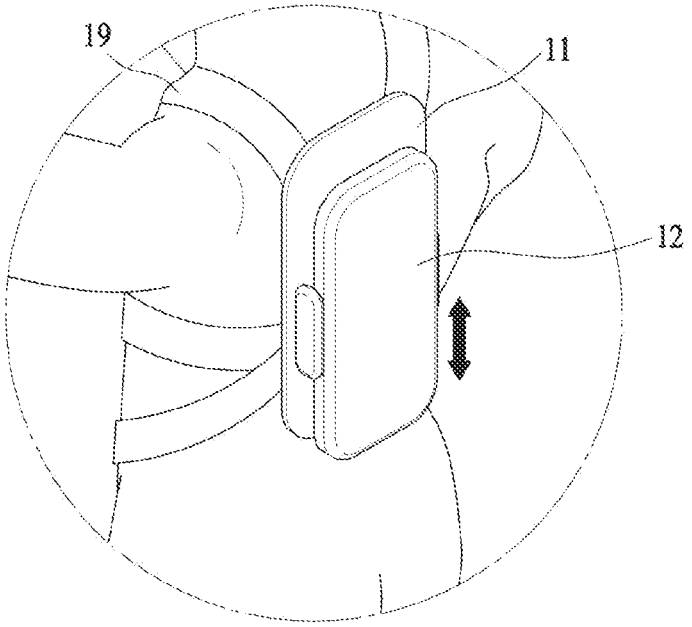
FIG. 2 is a perspective view illustrating the wearable fitness apparatus according to an example embodiment.

FIG. 1 is a perspective view illustrating a user wearing a wearable fitness apparatus according to an embodiment. FIG. 2 is a perspective view illustrating the wearable fitness apparatus according to an embodiment and FIG. 3 is another perspective view illustrating the wearable fitness apparatus according to an embodiment.

Figure 3:
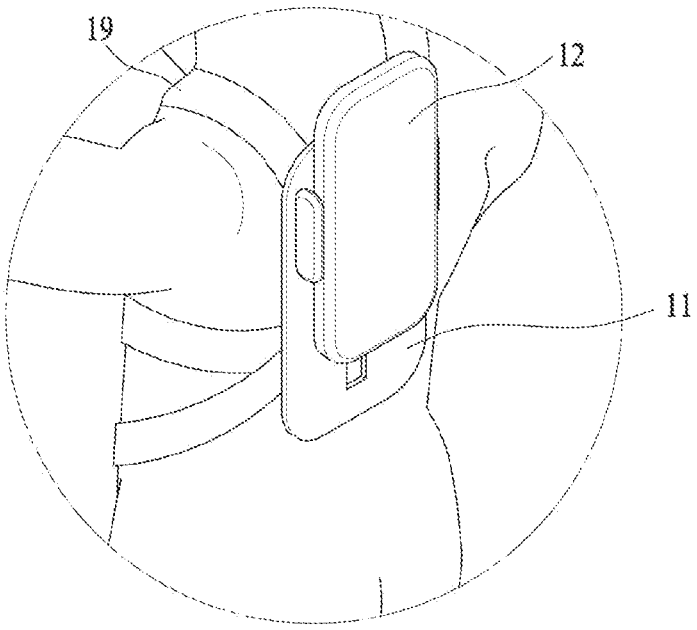
FIG. 3 is another perspective view illustrating the wearable fitness apparatus according to an example embodiment.

Referring to FIGS. 1 to 3, a wearable fitness apparatus (hereinafter, referred to as a fitness apparatus 100) using an elastic cable may be worn by a user. The user may perform various motions while wearing the fitness apparatus 100. The user may perform a muscle strength exercise while wearing the fitness apparatus 100. For example, the user may perform an upper limb exercise and/or a lower limb exercise while wearing the fitness apparatus 100. For example, the user may perform various exercises such as weight training, boxing, Pilates, or yoga while wearing the fitness apparatus 100. When the user exercises while wearing the fitness apparatus 100, the image of the user may be displayed on a display D. For example, various sensors provided in the fitness apparatus 100 may sense a current posture of the user. The various sensors may transmit sensed posture information to the display D. The display D may display the current image of the user based on information received from the various sensors.

The fitness apparatus 100 may include abase plate 11, a driving module 12 comprising a motor and/or a case, a wearing band 19, a plurality of body sensors 81 and 82, and a plurality of wearing parts 91, 92 and 93.

The base plate 11 may be worn on the back of the user. For example, the base plate 11 may have a flat plate shape. The front surface of the base plate 11 may face the back of the user. The rear surface of the base plate 11 may face the driving module 12 to be described below.

The driving module 12 may adjust the magnitude of force applied to the user. The driving module 12 may apply force to at least one of the wearing parts 91, 92 and 93 worn by the user using an elastic cable. The driving module 12 may adjust the exercise intensity of the user by adjusting the magnitude of force applied to the wearing part. The driving module 12 may sense exercise performance of the user and readjust exercise intensity in real-time. For example, the driving module 12 may readjust exercise intensity based on sensed beats per minute (BPM) of the user. For example, the driving module 12 may readjust the exercise intensity based on sensed movement of joints or muscles of the user, or activity of the muscles. The BPM and/or joint movement of the user may be sensed by the plurality of body sensors 81 and 82. The driving module 12 may exchange information with the plurality of body sensors 81 and 82. For example, the driving module 12 and the plurality of body sensors 81 and 82 may be wired or wirelessly connected to each other.

The driving module 12 may be connected, directly or indirectly, to the base plate 11. The driving module 12 may be connected to the base plate 11 to be detachable. The driving module 12 may move along the base plate 11. The driving module 12 may translate and/or rotate along the base plate 11.

The wearing band 19 may be connected, directly or indirectly, to the base plate 11 and wrap around the upper body of the user. The wearing band 19 may fix the base plate 11 to the upper body of the user. The wearing band 19 may be connected to the base plate 11. The wearing band 19 may be provided, for example, in plurality. The length of the wearing band 19 may be adjusted based on the body size of the user.

The plurality of body sensors 81 and 82 may sense body information of the user. For example, the plurality of body sensors 81 and 82 may include a pulse sensor 81 to measure the BPM of the user and an inertial measurement unit (IMU) sensor 82 to measure a joint angle of the user. The pulse sensor 81 and/or the IMU sensor 82 may be provided in plurality. For example, the pulse sensor 81 may be provided at a position at which the BPM of the user may be effectively sensed. For example, the pulse sensor 81 may be disposed near the wrist of the user. For example, the IMU sensor 82 may be provided in plurality. The IMU sensor 82 may be disposed near the wrist, shoulder, thigh and/or ankle of the user.

The plurality of wearing parts 91, 92, and 93 may be worn on the body of the user. The plurality of wearing parts 91, 92, and 93 may be provided spaced from each other or connected, directly or indirectly, to each other. In the drawing, the wearing parts 91, 92, and 93 are shown separated from each other but the wearing parts 91, 92, and 93 are not limited thereto. For example, the plurality of wearing parts 91, 92, and 93 may be connected to each other through a connecting member (not shown).

The plurality of wearing parts 91, 92, and 93 may include an arm wearing part 91 worn on an arm of the user, a knee wearing part 92 worn on a knee of the user, and an ankle wearing part 93 worn on an ankle of the user. It is noted that positions of the plurality of wearing parts 91, 92, and 93 are not limited thereto. The IMU sensor 82 may be disposed on each wearing part.

Figure 4:
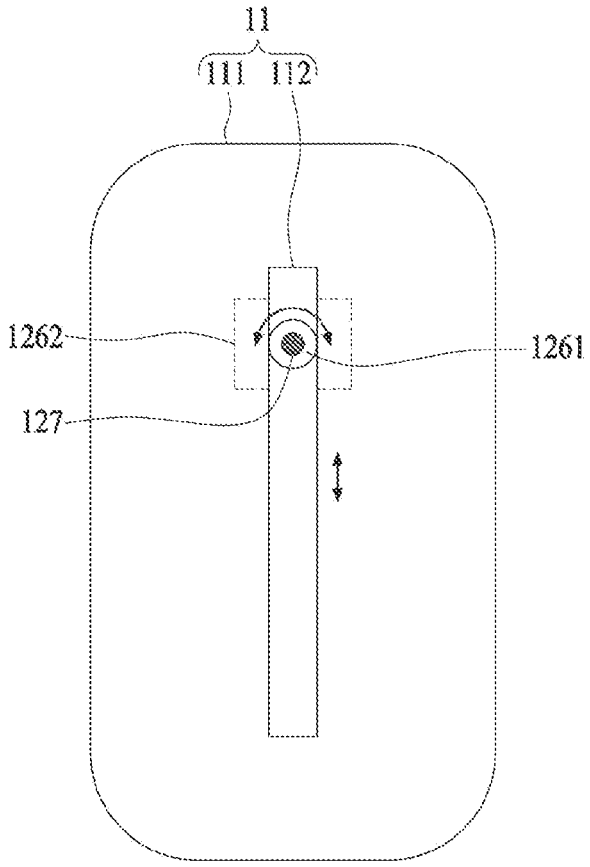
FIG. 4 is a rear view illustrating a connecting portion of a base plate and a driving module according to an example embodiment.

FIG. 4 is a rear view illustrating a connecting portion of a base plate and a driving module according to an embodiment.

Referring to FIG. 4, the base plate 11 may include a plate body 111 and a plate guide 112. The plate body 111 may have a hollow therein. The plate body 111 may be provided while being worn on the body of the user. The plate guide 112 may be recessed in the rear surface of the plate body 111. The plate guide 112 may guide movement of the driving module 12.

The driving module may include a slider body 1262 that is slidable along the hollow of the plate body 111, a slider head 1261 that protrudes from the slider body 1262 and is movable along the plate guide 112, and a slider rod 127 connected, directly or indirectly, to the slider head 1261 to be rotatable. For example, the slider rod 127 may be connected, directly or indirectly, to a module case 121 (see FIG. 5) to be described below. For example, the slider rod 127 may be provided to the slider head 1261 to be detachable. The slider body 1262 may slide in the vertical direction. The slider rod 127 may be provided with respect to the slider head 1261 to be rotatable.

The base plate 11 may have a first fixing member (not shown) to fix a position of the slider rod 127. For example, the user may move the slider body 1262 vertically in a state in which the first fixing member is released. When the slider body 1262 reaches a desired position, the user may move the first fixing member and fix the position of the slider body 1262.

The driving module may have a second driving member (not shown) to fix a position of the slider rod 127 with respect to the slider head 1261. For example, the user may relatively rotate the slider rod 127 with respect to the slider head 1261 in a state in which a second fixing member is released. When the module case 121 (see FIG. 5) reaches a desired position, the user may move the second fixing member and fix the position of the module case 121.

Figure 5:
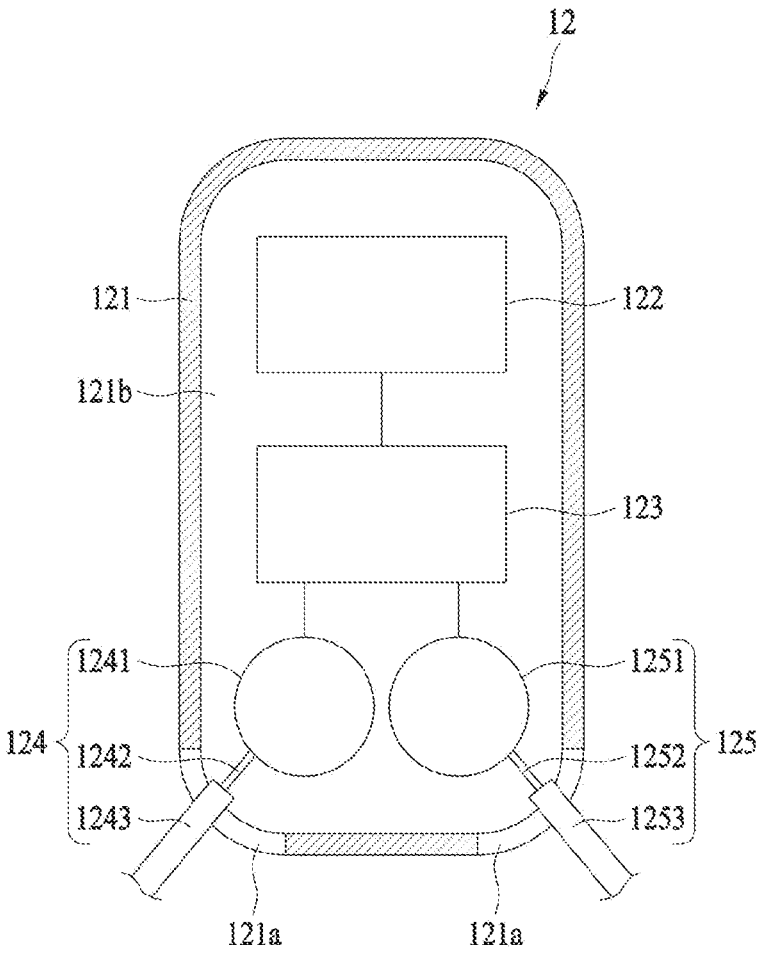
FIG. 5 is a cross-sectional view illustrating a driving module according to an example embodiment.

FIG. 5 is a cross-sectional view illustrating a driving module according to an embodiment.

Referring to FIG. 5, the driving module 12 may adjust the magnitude of tension. The driving module 12 may transmit force to the wearing parts that support a part of the body of the user. The driving module 12 may adjust the magnitude of force applied to the wearing parts. The driving module 12 may include the module case 121, a battery 122, a controller 123, a first actuator 124, and a second actuator 125.

The module case 121 may include an opening 121*a* and a hollow 121*b* communicating with the outside through the opening 121*a*. The opening 121*a* may be provided as a pair. For example, the opening 121*a* may be in the lower side of the module case 121. The module case 121 may accommodate the battery 122, the controller 123, the first actuator 124, and the second actuator 125.

The battery 122 may be in the module case 121. For example, the battery 122 may be in the hollow 121*b* of the module case 121.

The controller 123 may be connected, directly or indirectly, to the battery 122. The controller 123 may be in the module case 121. For example, the controller 123 may be in the hollow 121*b* of the module case 121. The controller 123 may control the first actuator 124 and the second actuator 125.

The first actuator 124 may include a first motor 1241, a first inelastic cable 1242, and a first elastic cable 1243. The first inelastic cable 1242 and the first elastic cable 1243 are collectively referred to as cables herein.

The first inelastic cable 1242 may be provided to transmit force intactly to the first elastic cable 1243 from the first motor 1241. The first inelastic cable 1242 may be, for example, an inelastic wire, a fishing line, or a yacht line. For example, the first inelastic cable 1242 may have zero elasticity. The first elastic cable 1243 may be a rubber band. The first actuator 124 may have various effects by including the first inelastic cable 1242 and the first elastic cable 1243 simultaneously. The first actuator 124 may intactly transmit force to a first wearing part 91*a* (see FIG. 6) through the first inelastic cable 1242, and in a dangerous moment, the elasticity of the first elastic cable 1243 may absorb an unintended impact. For example, the first elastic cable 1243 may absorb an unintended impact in a situation where a person is wearing the fitness apparatus or a motor malfunctions. The first elastic cable 1243 may absorb noise among forces controlled by the controller 123 and transmitted from the user. The first actuator 124 may implement a short length by employing the first inelastic cable 1242 and the first elastic cable 1243 simultaneously and have various effects described above.

In an embodiment, the controller 123 may be implemented as a processor. The processor may be implemented as a general-purpose processor such as a central processing unit (CPU), a digital signal processor (DSP), an application processor (AP), and a communication processor (CP), a graphics-only processor such as a graphics processing unit (GPU), or a combination of one or more of an artificial intelligence (AI)-only processor such as a neural processing unit (NPU). Those skilled in the art will understand that the processing unit described above is merely an example, and that the processor is not limited as long as the processor is, for example, an arithmetic means capable of executing instructions stored in a memory and outputting an executed result.

The first motor 1241 may generate power. The first motor 1241 may deform the first inelastic cable 1242. For example, the first motor 1241 may pull or wind the first inelastic cable 1242. The first motor 1241 may be controlled by the controller 123, comprising processing circuitry. The first motor 1241 may have an output end. The output end of the first motor 1241 may rotate. The output end of the first motor 1241 may rotate clockwise or counterclockwise. The rotational speed of the output end of the first motor 1241 may be controlled by the controller 123. Each "controller" herein may comprise processing circuitry. The first inelastic cable 1242 may be connected, directly or indirectly, to the output end of the first motor 1241. The first inelastic cable 1242 may be between the first motor 1241 and the first elastic cable 1243 and connect the first motor 1241 to the first elastic cable 1243.

The first elastic cable 1243 may be connected, directly or indirectly, to the wearing parts. The first elastic cable 1243 may deform in a longitudinal direction. For example, when large tension is applied to the first elastic cable 1243, a large load may be applied to the user. The first elastic cable 1243 may be replaced. For example, the user may replace the first elastic cable 1243 according to the purpose of exercise. For example, when the user requires a relatively strong exercise, the first elastic cable 1243 may be used by replacing the first elastic cable 1243 with an elastic cable having a relatively larger elastic coefficient. For example, when the user requires a relatively weak exercise, the first elastic cable 1243 may be used by replacing the first elastic cable 1243 with an elastic cable having a relatively smaller elastic coefficient.

The second actuator 125 may include a second motor 1251, a second inelastic cable 1252, and a second elastic cable 1253.

The second motor 1251 may generate power. The second motor 1251 may deform the second inelastic cable 1252. For example, the second motor 1251 may pull or wind the second inelastic cable 1252. The second motor 1251 may be controlled by the controller 123. The second motor 1251 may have an output end. The output end of the second motor 1251 may rotate. The output end of the second motor 1251 may rotate clockwise or counterclockwise. The rotational speed of the output end of the second motor 1251 may be controlled by the controller 123.

The second inelastic cable 1252 may be connected, directly or indirectly, to the output end of the second motor 1251. The second inelastic cable 1252 may be between the second motor 1251 and the second elastic cable 1253 and connect the second motor 1251 to the second elastic cable 1253.

The second elastic cable 1253 may be connected, directly or indirectly, to the wearing parts. The second elastic cable 1253 may deform in a longitudinal direction of the cable. For example, when large tension is applied to the second elastic cable 1253, a large load may be applied to the user.

It is noted that the first actuator 124 and the second actuator 125 may be referred to as an actuator herein. Similarly, the first motor 1241, the first inelastic cable 1242, and the first elastic cable 1243 may be referred to as a motor, an inelastic cable, and an elastic cable, respectively.

Figure 6:
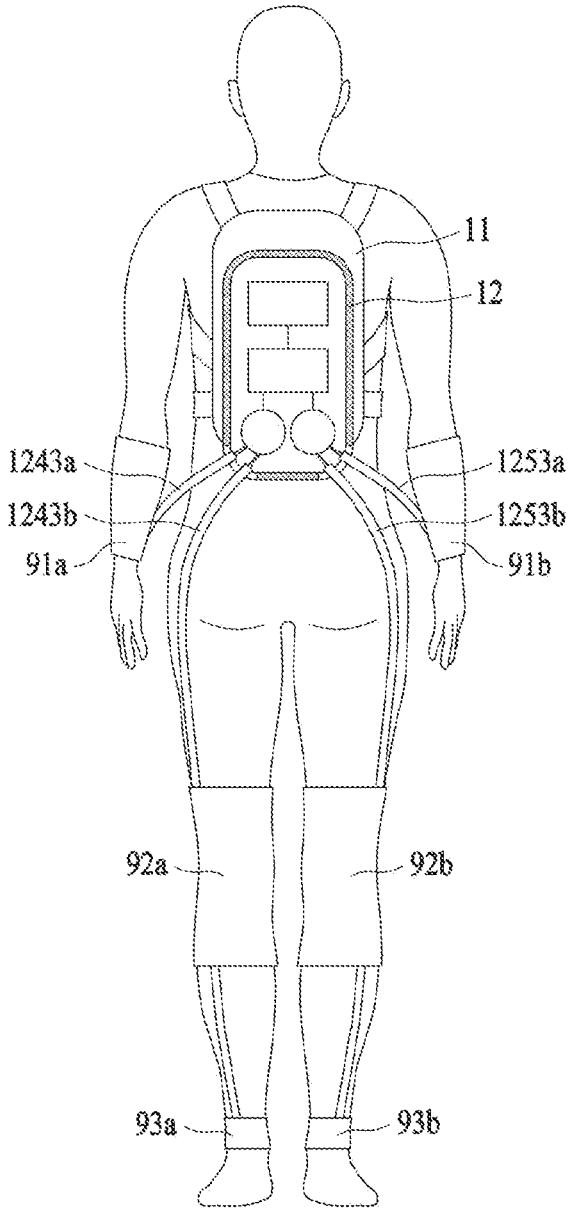
FIG. 6 is a rear view illustrating a user wearing a fitness apparatus according to an example embodiment.

FIG. 6 is a rear view illustrating a user wearing a fitness apparatus according to an embodiment.

Referring to FIG. 6, the fitness apparatus may include the base plate 11 to be worn on the back of the user and the driving module 12 provided to the base plate 11 to be detachable and provided along the base plate 11 to be movable. The driving module 12 may slide along the base plate 11 vertically or horizontally. The driving module 12 may rotate around the base plate 11.

The fitness apparatus may include wearing parts to be worn on the body of the user. The fitness apparatus may include a first wearing part 91*a*, a second wearing part 91*b*, a third wearing part 92*a*, a fourth wearing part 92*b*, a fifth wearing part 93*a*, and a sixth wearing part 93*b*. For example, the first wearing part 91*a* and the second wearing part 91*b* may be worn on the upper body of the user. For example, the third wearing part 92*a*, the fourth wearing part 92*b*, the fifth wearing part 93*a*, and the sixth wearing part 93*b* may be worn on the lower body of the user. Each wearing part herein may comprise at least one of a band, a strap, and/or a support. The band, strap, and/or support may, for example, be wrapped at least partially around the arm or leg of the user.

It is noted that the first wearing part 91*a*, the second wearing part 91*b*, the third wearing part 92*a*, the fourth wearing part 92*b*, the fifth wearing part 93*a*, and the sixth wearing part 93*b* may be referred to as a wearing part herein.

The driving module 12 may include a plurality of elastic cables. The cables may or may not be part of the driving module 12. The plurality of elastic cables may include a first elastic cable 1243*a* connected to the first wearing part 91*a*, a second elastic cable 1243*b* connected to the third wearing part 92*a* and the fifth wearing part 93*a*. a third elastic cable 1253*a* connected to the second wearing part 91*b*, and a fourth elastic cable 1253*b* connected to the fourth wearing part 92*b* and the sixth wearing part 93*b*.

The first elastic cable 1243*a* and the second elastic cable 1243*b* may be driven by one motor simultaneously. The third elastic cable 1253*a* and the fourth elastic cable 1253*b* may be driven by one motor simultaneously.

When the plurality of elastic cables is connected as described above, the user may perform various exercises. For example, the user may perform at least one of a side shoulder exercise, a back shoulder exercise, a triceps exercise, a bicep exercise, an abdominal muscle exercise, or a lower limb exercise.

The user may perform an upper limb exercise while wearing the fitness apparatus. For example, the user may perform a side shoulder exercise and/or a back shoulder exercise by repeating a motion of lifting both arms while standing upright. For example, the user may perform a triceps exercise by repeating a motion of lifting both arms backward while slightly bending the upper body forward. For example, the user may perform a biceps exercise by placing both arms forward, fixing the elbows, and repeating a motion of lifting the upper limbs while standing upright. A load applied to the user may be controlled by the driving module 12.

The user may perform an abdominal muscle exercise and a lower limb exercise while wearing the fitness apparatus. For example, the user may perform an abdominal muscle exercise by repeating a sit-up motion. For example, the user may perform a lower limb exercise by repeating a squat motion. A load applied to the user may be controlled by the driving module 12.

Figure 7:
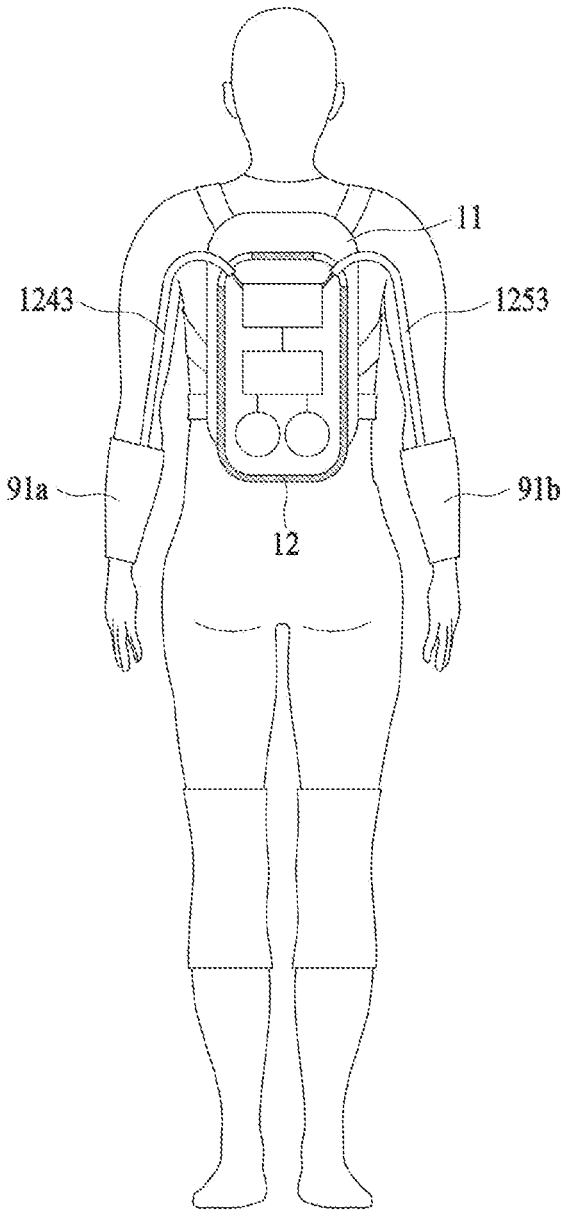
FIG. 7 is another rear view illustrating a user wearing a fitness apparatus according to an example embodiment.

FIG. 7 is another rear view illustrating a user wearing a fitness apparatus according to an embodiment.

Referring to FIG. 7, an angle of the driving module 12 may be adjusted with respect to the base plate 11. For example, the driving module 12 may be fixed with respect to the base plate 11 in a rotated state by 180 degrees (°). When an angle of the driving module 12 is adjusted, starting positions of the plurality of elastic cables 1243 and 1253 may change. The plurality of elastic cables 1243 and 1253 may be connected, directly or indirectly, to the wearing parts 91*a* and 91*b*, respectively.

In a state in which the plurality of elastic cables is connected as described above, the user may perform various exercises. For example, the user may perform a chest exercise or a front shoulder exercise. For example, the user may perform a chest exercise by repeating a motion of pushing both arms forward. For example, the user may perform a front shoulder exercise by repeating a motion of lifting both arms upward.

Figure 8:
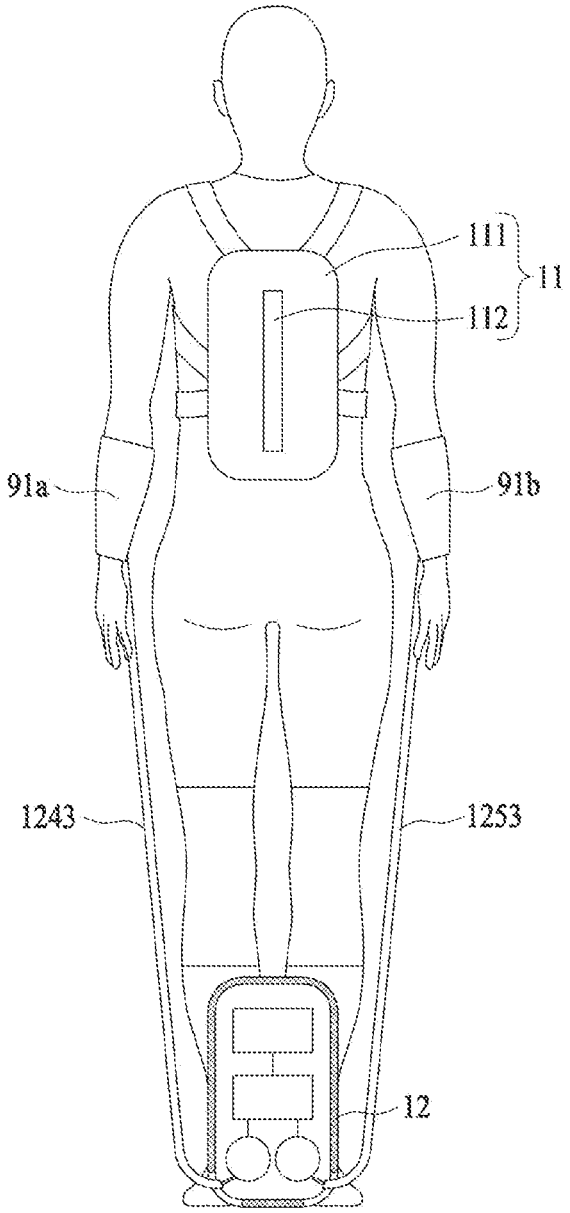
FIG. 8 is another rear view illustrating a user wearing a fitness apparatus according to an example embodiment.

FIG. 8 is another rear view illustrating a user wearing a fitness apparatus according to an embodiment.

Referring to FIG. 8, the driving module 12 may be separated from the base plate 11. The base plate 11 may include the plate body 111 and the plate guide 112. The driving module 12 may be separated from the base plate 11 and fixed outside of the base plate 11 or to the lower body of the user. For example, the driving module 12 may be supported on a ground or fixed near the ground by another object or the user. The plurality of elastic cables 1243 and 1253 may be connected to the wearing parts 91*a* and 91*b*, respectively.

In a state in which the plurality of elastic cables is connected as described above, the user may perform various exercises. For example, the user may perform a back exercise by repeating a motion of lifting both arms while bending the upper body forward. For example, the user may perform an abdominal muscle exercise by repeating a motion of twisting the upper body from side to side while raising both hands near the chest. For example, the user may perform a lower limb exercise by performing a lunge motion.

Figure 9:
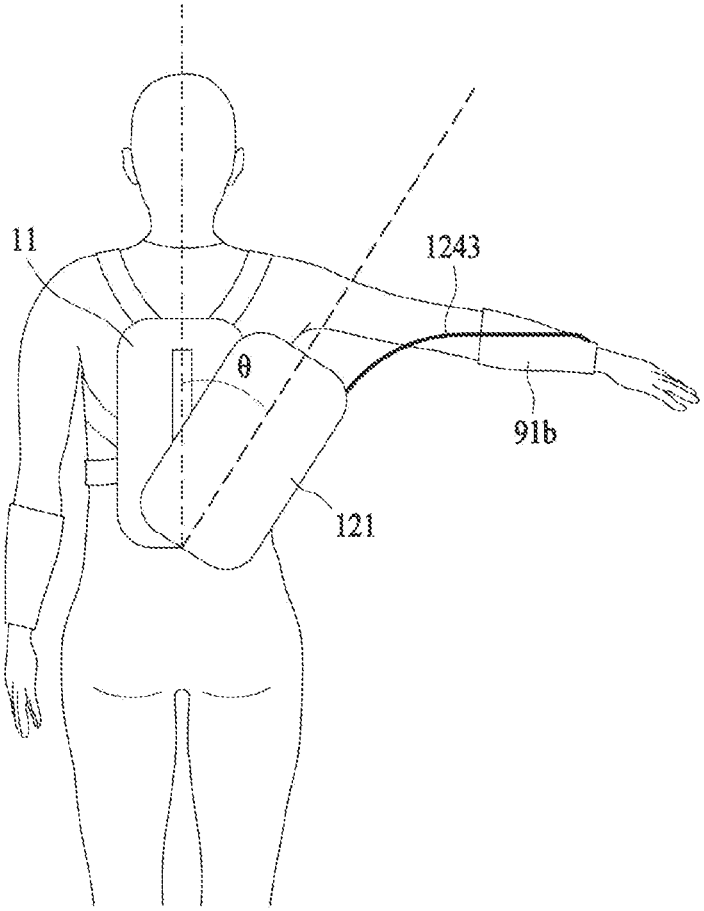
FIG. 9 is another rear view illustrating a user wearing a fitness apparatus according to an example embodiment.
Figure 10:
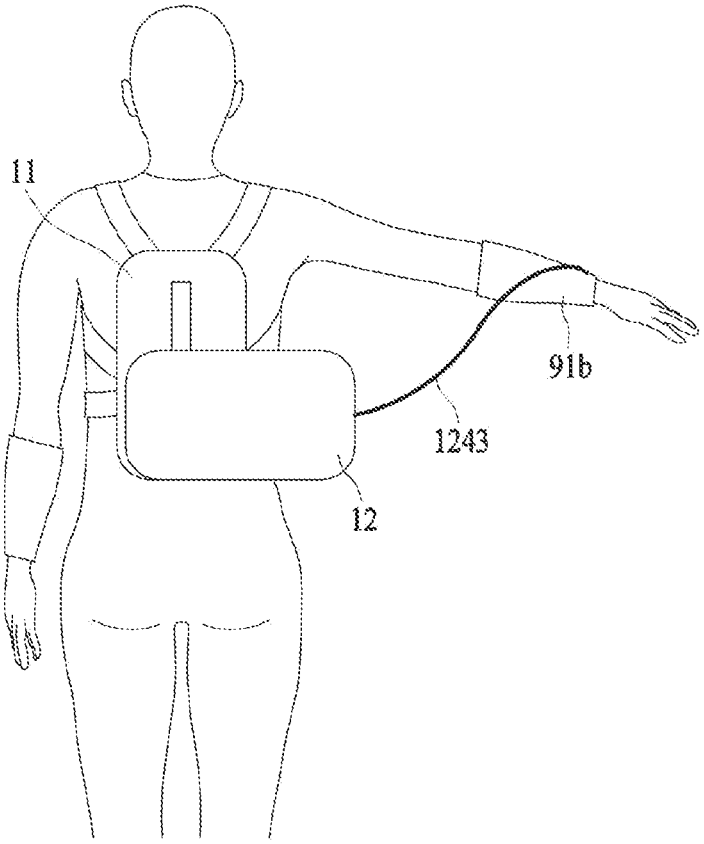
FIG. 10 is a rear view illustrating a state in which an angle of a module case is changed compared to FIG. 9.

FIG. 9 is another rear view illustrating a user wearing a fitness apparatus according to an embodiment and FIG. 10 is a rear view illustrating a state in which an angle of a module case is changed compared to FIG. 9.

Referring to FIGS. 9 and 10, an angle of the module case 121 of the driving module 12 may be adjusted with respect to the base plate 11. FIG. 9 may show one imaginary line passing through the center of the module case 121 in a longitudinal direction of the module case 121 and another imaginary line passing through the plate guide 112 in a longitudinal direction of the plate guide 112. An angle between the module case 121 and the base plate 11 may be understood as an angle between the two imaginary lines. An angle θ between the module case 121 and the base plate 11 may be adjusted. The elastic cable 1243 of the driving module 12 may be connected, directly or indirectly, to the wearing part 91*b*. When the angle θ between the module case 121 and the base plate 11 is adjusted, the magnitude of force applied to the user may be adjusted. For example, when the angle θ between the module case 121 and the base plate 11 increases, the user may perform the same exercise with relatively weak force.

Figure 11:
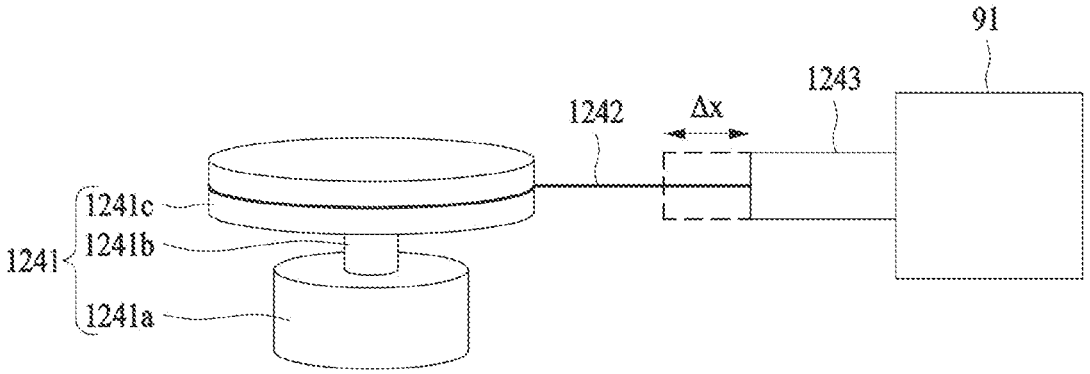
FIG. 11 is a perspective view illustrating an actuator and a wearing part according to an example embodiment.

FIG. 11 is a perspective view illustrating an actuator and a wearing part according to an embodiment.

Referring to FIG. 11, an actuator may include the motor 1241, the inelastic cable 1242, and the elastic cable 1243. The actuator may transmit force to the wearing part 91.

The motor 1241 may include a motor body 1241*a* that generates power, a motor shaft 1241*b* rotated by the power of the motor body 1241*a*, and an output end 1241*c* connected, directly or indirectly, to the motor shaft 1241*b*.

The inelastic cable 1242 may have one end that is fixed to the output end 1241*c*. The inelastic cable 1242 may be wound around the output end 1241*c* as the output end 1241*c* rotates.

The elastic cable 1243 may have one end that is fixed to the inelastic cable 1242 and the other end that is fixed to the wearing part 91. The elastic cable 1243 may be deformed by tension of the inelastic cable 1242. In the drawing, it is schematically illustrated that the length of the elastic cable 1243 may vary by x.

Figure 12:
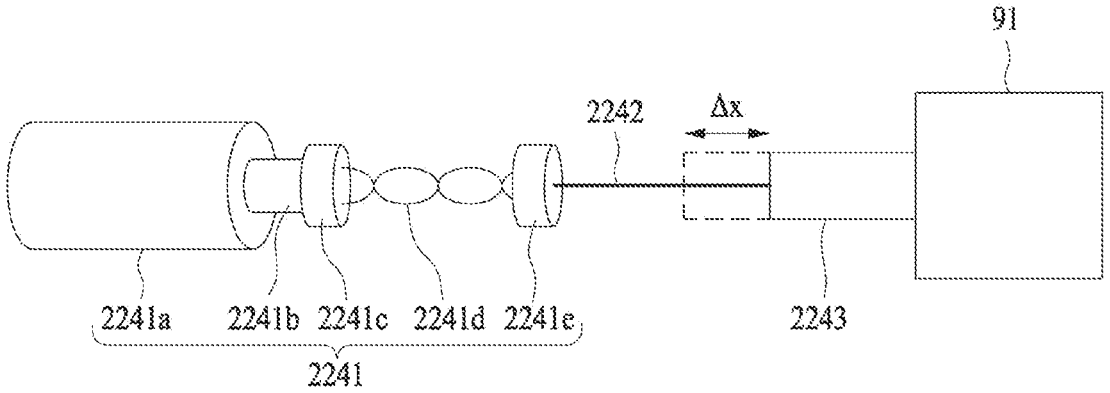
FIG. 12 is another perspective view illustrating an actuator and a wearing part according to an example embodiment.

FIG. 12 is another perspective view illustrating an actuator and a wearing part according to an embodiment.

Referring to FIG. 12, an actuator may include a motor 2241, an inelastic cable 2242, and an elastic cable 2243. The actuator may transmit force to the wearing part 91.

The motor 2241 may include a motor body 2241*a* that generates power, a motor shaft 2241*b* rotated by the power of the motor body 2241*a*, a first output end 2241*c* connected to the motor shaft 2241*b*, a pair of strings 2241*d* connected to the first output end 2241*c*, and a second output end 2241*e* that supports the pair of strings 2241*d* and faces the first output end 2241*c*. A distance between the first output end 2241*c* and the second output end 2241*e* may be adjusted.

The inelastic cable 2242 may have one end that is fixed to the second output end 2241*e*. The inelastic cable 2242 may move together as the second output end 2241*e* moves.

The elastic cable 2243 may have one end that is fixed to the inelastic cable 2242 and the other end that is fixed to the wearing part 91. The elastic cable 2243 may be deformed by tension of the inelastic cable 2242. In the drawing, it is schematically illustrated that the length of the elastic cable 2243 may vary by x.

Figure 13:
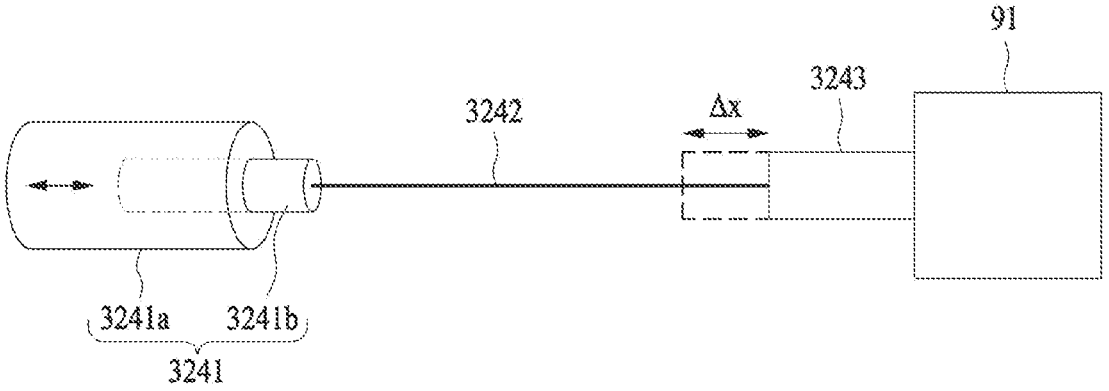
FIG. 13 is another perspective view illustrating an actuator and a wearing part according to an example embodiment.

FIG. 13 is another perspective view illustrating an actuator and a wearing part according to an embodiment.

Referring to FIG. 13, an actuator may include a motor 3241, an inelastic cable 3242, and an elastic cable 3243. The actuator may transmit force to the wearing part 91.

The motor 3241 may include a motor body 3241*a* that generates power and a motor head 3241*b* slidable along the motor body 3241*a*. The motor head 3241*b* may move in a longitudinal direction.

The inelastic cable 3242 may move together as the motor head 3241*b* moves.

The elastic cable 3243 may have one end that is fixed to the inelastic cable 3242 and the other end that is fixed to the wearing part 91. The elastic cable 3243 may be deformed by tension of the inelastic cable 3242. In the drawings, it is schematically illustrated that the length of the elastic cable 3243 may vary by x.

Figure 14:
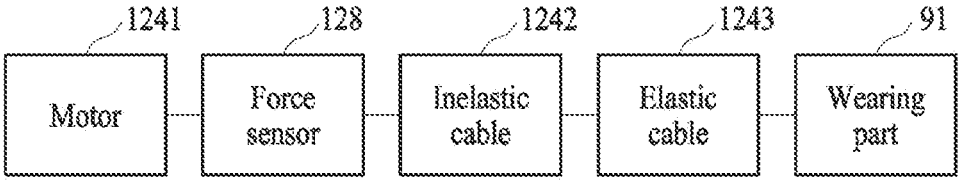
FIG. 14 is a block diagram illustrating a power transmission mechanism according to an example embodiment.

FIG. 14 is a block diagram illustrating a power transmission mechanism according to an embodiment.

Referring to FIG. 14, power generated by the motor 1241 may sequentially pass through a force sensor 128, the inelastic cable 1242, and the elastic cable 1243 and may be transmitted to the wearing part 91. The force sensor 128 may be provided on a path through which power is transmitted from the motor 1241 to the wearing part 91. When force is applied to a structure, the force sensor 128 may estimate force corresponding to a current value by measuring a value of a change in the amount of light according to a displacement of the structure and converting the value of the change in the amount of light into the current value. For example, the force sensor 128 may be between the motor 1241 and the inelastic cable 1242. In this case, an output end of the motor 1241 may be connected to one side of the force sensor 128 and the inelastic cable 1242 may be connected, directly or indirectly, to the other side of the force sensor 128. For example, the force sensor 128 may be provided on one side of the inelastic cable 1242. In this case, a part of the inelastic cable 1242 may be connected, directly or indirectly, to one side of the force sensor 128 and another part of the inelastic cable 1242 may be connected, directly or indirectly, to the other side of the force sensor 128. The force sensor 128 may sense how much force is being applied to the wearing part 91. It is noted that the force sensor 128 may be referred to as a tension measurement sensor herein.

Figure 15:
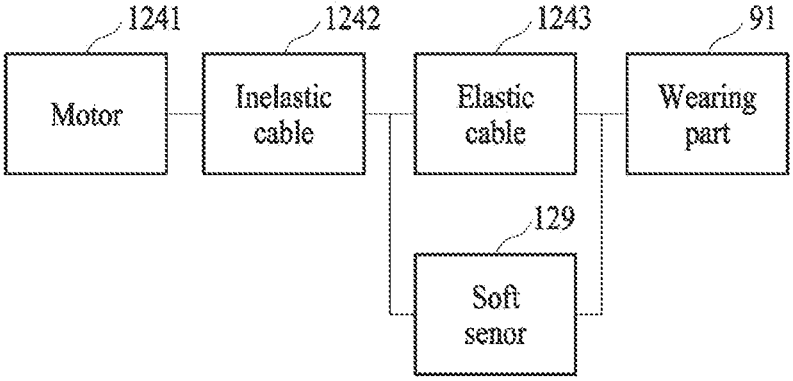
FIG. 15 is another block diagram illustrating a power transmission mechanism according to an example embodiment.

FIG. 15 is another block diagram illustrating a power transmission mechanism according to an embodiment.

Referring to FIG. 15, power generated by the motor 1241 may sequentially pass through the inelastic cable 1242 and the elastic cable 1243 and be transmitted to the wearing part 91. The fitness apparatus may further include a soft sensor 129 to measure a displacement of the elastic cable 1243. When force is applied to a structure, the soft sensor 129 may estimate the force applied to the structure by measuring a change in a resistance value, change in capacitance, or change in the amount of light according to deformation of the structure. The soft sensor 129 may measure an extension rate of the elastic cable 1243. The soft sensor 129 may sense how much force is being applied to the wearing part 91 by measuring the extension rate of the elastic cable 1243. It is noted that the soft sensor 129 may be referred to as a tension measurement sensor herein.

Figure 16:
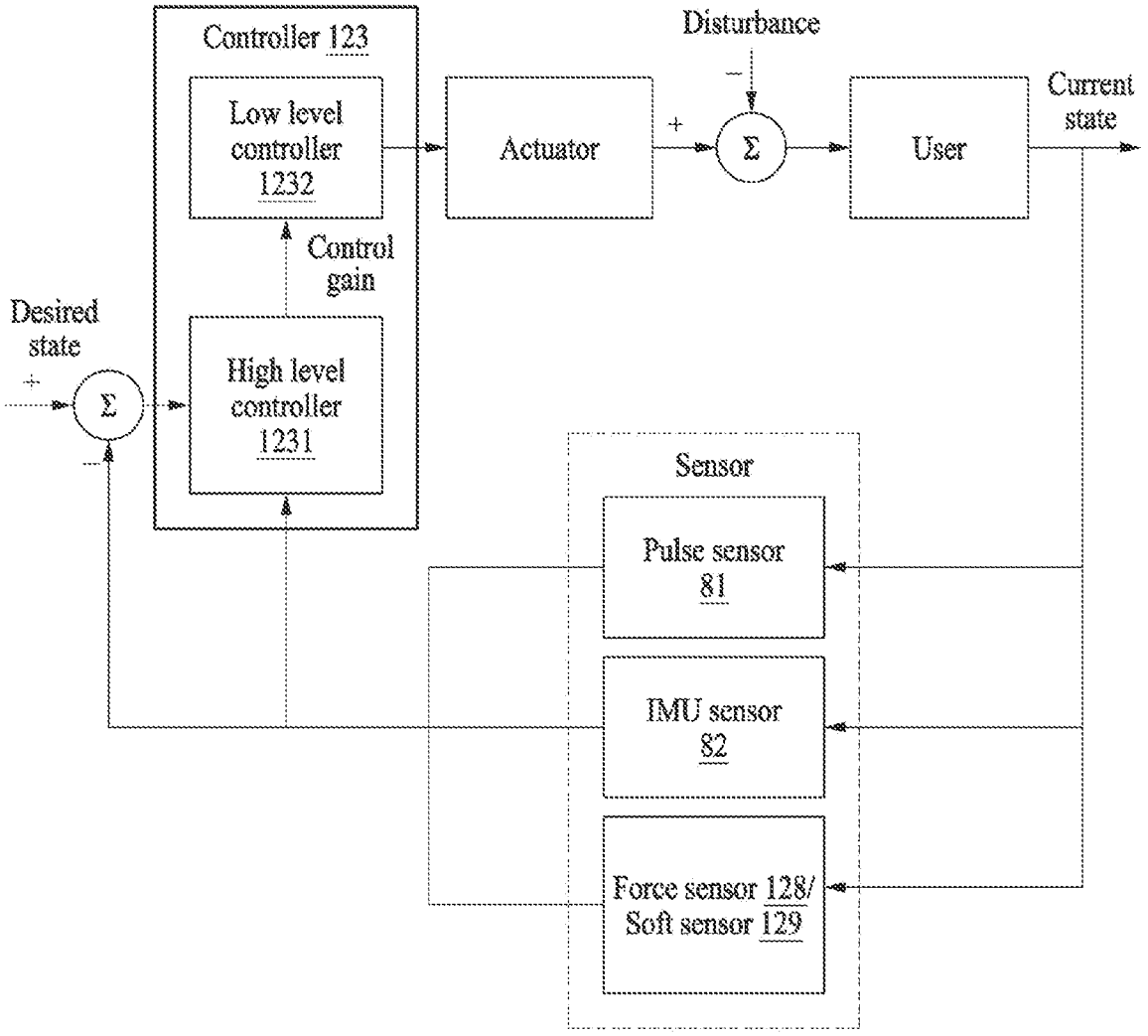
FIG. 16 is a flowchart illustrating a mechanism for adjusting exercise intensity in a fitness apparatus according to an example embodiment.

FIG. 16 is a flowchart illustrating a mechanism for adjusting exercise intensity in a fitness apparatus according to an embodiment.

Referring to FIG. 16, the fitness apparatus may implement force feedback control so that a desired load profile is generated for various types of exercise. The desired load profile may refer to an optimal level of exercise intensity that allows the user to maximize or improve exercise stimulation when the desired load profile is provided to the user. Here, a load profile may refer to force generated when the user pulls the elastic cable. The load profile may also express a change in the magnitude of force over time as a trajectory along the time axis and the magnitude axis of the force. The force generated at this time may be maintained at a constant value or at a constant level over time by a motor or may change to an intended magnitude. For example, the controller may determine the type of exercise performed by the user based on state information of the user and measured tension information. The controller may control the driving module to provide the user with the load profile corresponding to the type of exercise performed by the user.

First, a desired state may be input to the controller 123. Here, the desired state may refer to an exercise state in which exercise stimulation may be maximized or improved when the user exercises. For example, the desired state may include an optimal BPM, a joint angle, tension and an extension rate of the elastic cable, and the like. The controller 123 may include a high level controller 1231 and a low level controller 1232.

The high level controller 1231 may predict the type of exercise using machine learning. The high level controller 1231 may select user-customized exercise intensity suitable for the predicted exercise type and select a control gain to control force. Here, the control gain may refer to a proportional P, integral I, and derivative D gains in PID control. The low level controller 1232 may control an actuator based on the selected control gain.

When the low level controller 1232 controls the actuator, and then the force is transmitted to the wearing part from the actuator, an error may occur due to an external disturbance. For example, the external disturbance factors may include friction between the elastic cable and the wearing part, distortion of the wearing part, and the like. For example, when an error occurs due to the distortion of the wearable part, the high level controller 1231 may predict the degree of distortion by estimating a joint angle and the low level controller 1232 may control tension of the elastic cable in real-time.

A general-purpose processor such as a CPU, a DSP, an AP, a CP, and the like, a graphics-only processor such as a GPU and a vision processing unit (VPU), or a combination of AI-only processors such as an NPU to implement the high level controller 1231 and the low level controller 1232 may be mechanically detachable and easily configured to meet requirements of a system. For example, fastening using a bolt and a hook may be implemented. In addition, the high level controller 1231 and the low level controller 1232 may be physically separated as separate processors. The requirements of the system may refer to the AI information processing speed and accuracy that select the type of exercise and exercise intensity.

Force may be applied to the user and the user may perform a desired exercise. Various sensors provided in the fitness apparatus may sense a current state of the user. For example, the pulse sensor 81 may measure the BPM of the user. The IMU sensor 82 may sense the posture of the user. For example, the IMU sensor 82 may measure the angle of the joint of the user forms. The force sensor 128 and/or the soft sensor 129 may measure how much force is being applied to the wearing part. An electromyography sensor (not shown) may measure of muscle activity of the user.

The current state of the user sensed by a sensor may be provided to the controller 123 again. The high level controller 1231 may select a control gain again by comparing the provided current state of the user with an input desired state. Through feedback control, an error caused by external disturbance may be reduced.

Figure 17:
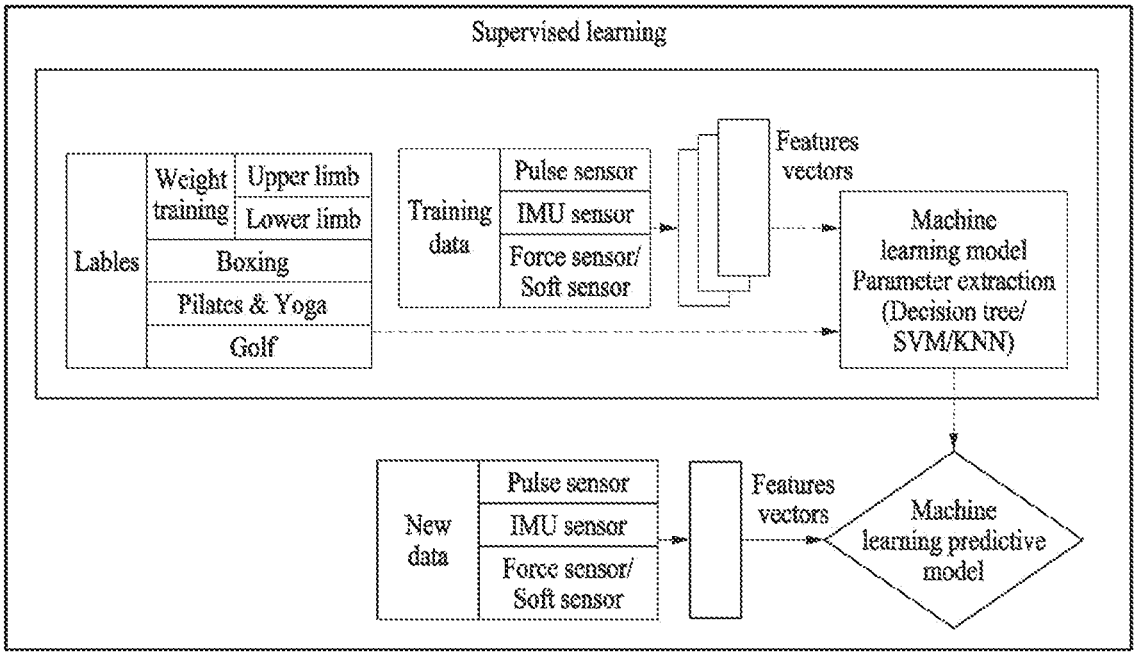
FIG. 17 is a flowchart illustrating a method of predicting a label of an exercise in a high level controller, according to an example embodiment.

FIG. 17 is a flowchart illustrating a method of predicting a label of an exercise in a high level controller, according to an embodiment.

Referring to FIG. 17, a method of predicting a label of an exercise may perform machine learning (ML) based on a plurality of sensors and estimate the exercise label through machine learning. Exercise intensity may vary depending on the gender, age, and/or muscle mass of the user. The fitness apparatus may collect training data at every operation while the user is wearing the fitness apparatus. For example, the training data may be BPM, a joint angle, and/or force. For example, when the user performs a boxing exercise while wearing the fitness apparatus, the fitness apparatus may collect body information data of the user.

The fitness apparatus may use supervised learning among ML techniques to infer one function from training data. The fitness apparatus may design an ML model parameter extraction algorithm and may design an ML predictive model that estimates the label of exercise in real-time based on the corresponding ML model.

The fitness apparatus may extract a feature vector representing an exercise feature based on training data for various exercises, and then extract a parameter for the ML model of various types. The ML model may be, for example, a decision tree, a support vector machine, and/or K-Nearest Neighbors.

Here, the feature vector may be a vector expressed by quantifying a value sensed by each sensor. For example, when feature space having x, y, and z axes exists, the axes are BPM, a joint angle, and tension, respectively, and each sensed value may be quantified and expressed as x, y, and z coordinates. The ML predictive model may find a function that may classify and label areas of coordinates.

The fitness apparatus may form a predictive model based on an extracted parameter and predict the label of exercise. The ML predictive model may apply an ML model that may provide the user with the most accurate result among ML models to new data acquired in real-time by the plurality of sensors. For example, the ML model applied to the new data may be an ML model having high accuracy in selecting the label of exercise or accuracy in selecting appropriate exercise intensity.

For the predicted exercise, the fitness apparatus may set exercise intensity so that the user maintains a specific level of BPM or a joint angle. The fitness apparatus may monitor whether the user maintains a correct posture with appropriate exercise intensity. The fitness apparatus may reset the exercise intensity in real-time based on the exercise accuracy of the user.

To prepare for a situation when the fitness apparatus incorrectly predicts the label of exercise may be selected through voice recognition of the user. The user may reset the label of exercise predicted by the high level controller by uttering a certain word when the label of exercise predicted by the fitness apparatus is wrong. Alternatively, the user may set the label of exercise in advance through voice recognition before the high level controller predicts the label of exercise. A voice recognition module may recognize the type of exercise through a microphone via a general-purpose processor and the high level controller may also include a voice processing function. In an embodiment, when the user recognizes that the label of exercise is incorrectly predicted after turning on the fitness apparatus or during exercise, the high level controller of the fitness apparatus may adjust exercise intensity based on information from the sensors when the user utters a certain label of exercise.

Figure 18:
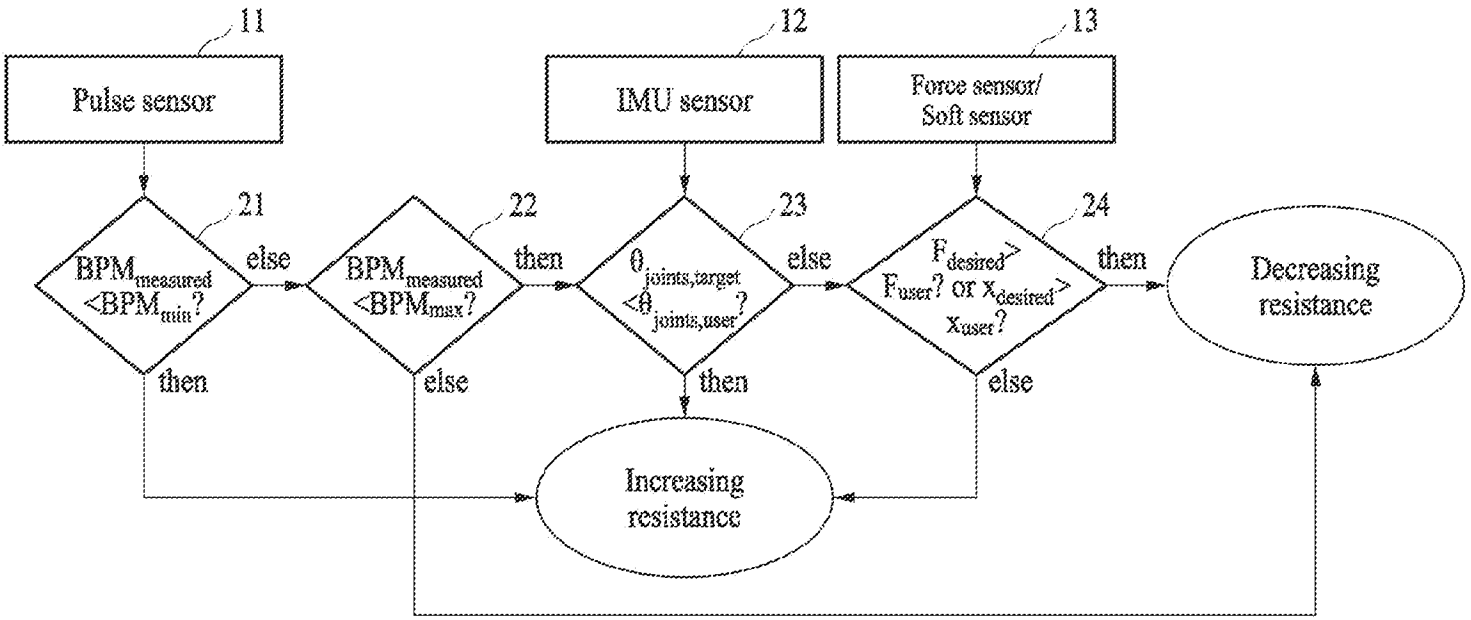
FIG. 18 is a flowchart illustrating a method of selecting exercise intensity, according to an example embodiment.

FIG. 18 is a flowchart illustrating a method of selecting exercise intensity, according to an embodiment.

Referring to FIG. 18, when the user performs an exercise such as weight training, boxing, Pilates, or yoga, the fitness apparatus may set exercise intensity so that the BPM of the user is maintained at a constant level. When exercise intensity and a control gain are selected in the high level controller, the low level controller may control an actuator. The magnitude of load applied to the user may vary due to a change in tension of the elastic cable.

The method of selecting exercise intensity may include operation 11 of measuring BPM through a pulse sensor, operation 12 of sensing the posture of the user through an IMU sensor, and operation 13 of sensing the magnitude of force applied to a wearing part through a force sensor and/or a soft sensor.

The method of selecting exercise intensity may include operation 21 of comparing a measured BPM (BPMmeasured) to a minimum BPM (BPMmin). Here, the BPMmin may be determined according to an exercise to be performed by the user and the physical condition of the user. For example, when the user performs weight training, the BPMmin may be "80". When the user performs boxing, the BPMmin may be "110". When the user performs Pilates or yoga, the BPMmin may be "70".

In operation 21, when the BPMmeasured is less than the BPMmin, a driving module may increase the magnitude of force applied to a wearing part by pulling an elastic cable. The magnitude of resistance force acting in a direction opposite to the movement direction of the user may increase. To perform the same motion, the magnitude of force to be applied by the user may increase. The amount of exercise of the user increases and the BPM may increase.

In operation 21, when the BPMmeasured is not less than the BPMmin, operation 22 may be performed. The method of selecting exercise intensity may include operation 22 of comparing the BPMmeasured and a maximum BPM (BPMmax). Here, the BPMmax may be determined according to an exercise to be performed by the user and the physical condition of the user. For example, when the user performs weight training, the BPMmax may be "120". When the user performs boxing, the BPMmax may be "160". When the user performs Pilates or yoga, the BPMmax may be "100".

In operation 22, when the BPMmeasured is not less than the BPMmax, a driving module may reduce the magnitude of force applied to a wearing part by unwinding an elastic cable. The magnitude of resistance force acting in a direction opposite to the movement direction of the user may decrease. To perform the same motion, the magnitude of force to be applied by the user may be reduced. The amount of exercise of the user may decrease and the BPM may decrease.

In operation 22, when the BPMmeasured is less than the BPMmin, operation 23 may be performed. The driving module may increase the amount of force applied to a wearing part by pulling an elastic cable.

In operation 23, the controller may compare a joint target angle $\theta_{joints,target}$ with an actual joint angle of the user $\theta_{joints,user}$. Here, $\theta_{joints,target}$ denotes an angle desired by the user. When the user overcomes the force applied to a wearing part and moves the joint sufficiently by the desired angle, $\theta_{joints,user}$ may be greater than or equal to $\theta_{joints,target}$.

In operation 23, when $\theta_{joints,user}$ is greater than $\theta_{joints,target}$, the driving module may increase the magnitude of force applied to a wearing part by pulling an elastic cable.

In operation 24, the controller may compare force ($F_{user}$) measured by a force sensor with desired force ($F_{desired}$). When $F_{user}$ is greater than $F_{desired}$, the driving module may reduce the magnitude of force applied to a wearing part by unwinding an elastic cable.

In operation 24, the controller may compare a displacement ($X_{user}$) measured by a soft sensor with a desired displacement ($X_{desired}$). When $X_{user}$ is greater than $X_{desired}$, the driving module may reduce the magnitude of force applied to a wearing part by unwinding an elastic cable.

Figure 19:
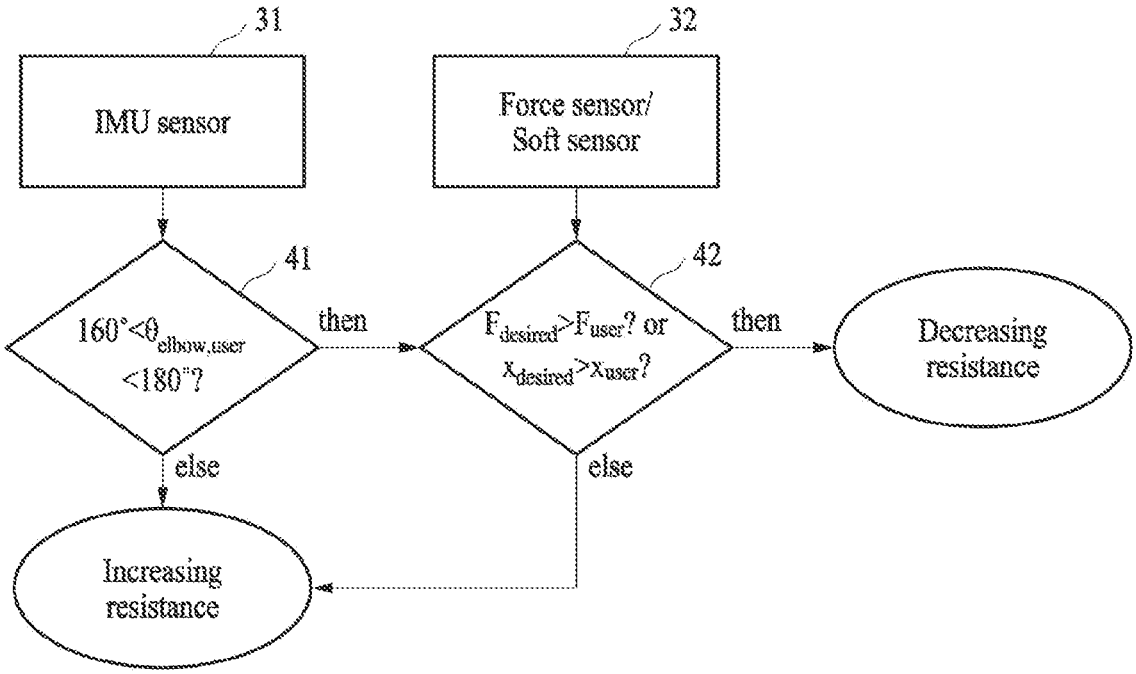
FIG. 19 is another flowchart illustrating a method of selecting exercise intensity, according to an example embodiment.

FIG. 19 is another flowchart illustrating a method of selecting exercise intensity, according to an embodiment.

Referring to FIG. 19, when the user performs an exercise requiring precise movement, such as golf, the fitness apparatus may determine whether the user is moving the body at an accurate angle and reset exercise intensity based on the corresponding information.

The method of selecting exercise intensity may include operation 31 of sensing the posture of the user through an IMU sensor and operation 32 of sensing the magnitude of force applied to a wearing part through a force sensor and/or a soft sensor.

The method of selecting exercise intensity may include operation 41 of determining whether an elbow angle ($\theta_{elbow,user}$) is in a certain angle range and operation 42 of comparing $F_{user}$ with $F_{desired}$ or comparing $X_{user}$ with $X_{desired}$.

Figure 20:
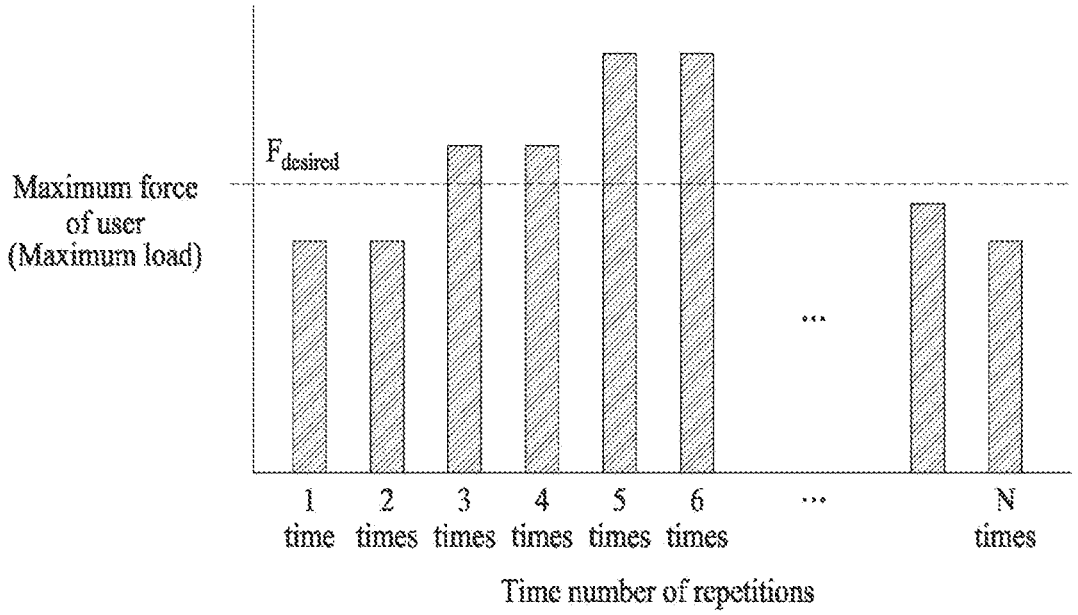
FIG. 20 is a graph illustrating the magnitude of a maximum load for the number of repetitions of exercise of a user according to an example embodiment.
Figure 21:
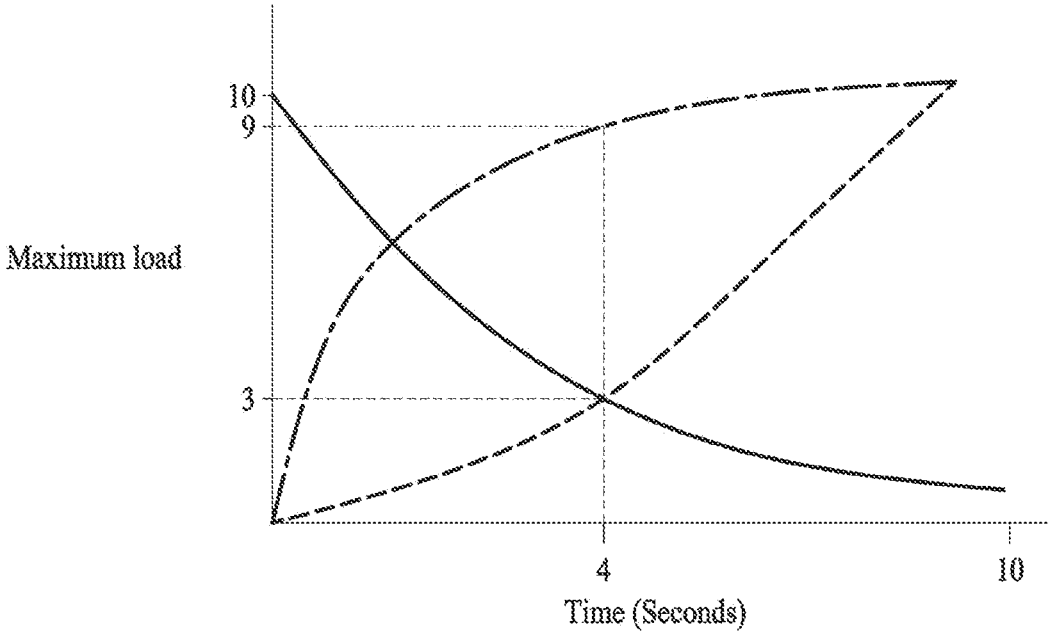
FIG. 21 is a graph illustrating the magnitude of a maximum load for time according to an example embodiment.

FIG. 20 is a graph illustrating the magnitude of a maximum load for the number of repetitions of exercise of the user according to an embodiment and FIG. 21 is a graph illustrating the magnitude of a maximum load for time according to an embodiment.

Referring to FIGS. 20 and 21, the fitness apparatus may adjust a load applied to the joint of the user in real-time while the user is exercising. For example, the controller may provide various load profiles so that the user exercises at optimal intensity. For example, the controller may maximize or increase exercise stimulation by appropriately adjusting the intensity of tension applied to an elastic cable while the user is exercising and may increase or strengthen the muscles of the user even when the user repeatedly performs the same motion.

Referring to FIG. 20, when the user performs a set exercise in which the same motion is repeatedly performed at intervals of time, the magnitude of maximum force applied to each time number may not be the same. The fitness apparatus may set $F_{desired}$ for the set exercise and operate so that the user exercises with $F_{desired}$ for each time. For example, $F_{desired}$ may be set by analyzing data according to a repetitive exercise and may be intensity that provides an optimal amount of exercise to the user.

For example, at 6 repetitions, the magnitude of the maximum force applied by the user may be greater than $F_{desired}$. $F_{user}$ may be provided to the high level controller, and the high level controller may calculate a control gain. The driving module, comprising at least a motor, may be controlled by unwinding an elastic cable by the low level controller and the magnitude of force applied to a wearing part may be reduced.

Referring to FIG. 21, the speed at which an elastic cable is pulled or released by a motor may not be constant. The amount of change in load over time may not be constant. For example, when the user performs a set of exercises over 10 seconds, the controller may sequentially increase the load from "0" to "10" while 0 to 10 seconds flow.

In another example, the controller may rapidly increase the load at the beginning of exercise so that the load increases up to "9" at 4 seconds and may set a profile so that the load increases slowly between 4 and 10 seconds. The motor may increase the magnitude of force applied by the user from the beginning of the exercise by pulling an elastic cable faster than the movement of the user.

In another example, the controller may slowly increase the load at the beginning of the exercise so that the load increases up to "3" at 4 seconds and may set the profile so that the load increases rapidly between 4 and 10 seconds.

In another example, the controller may set the profile so that the load gradually decreases from 10 to 0.

Figure 22:
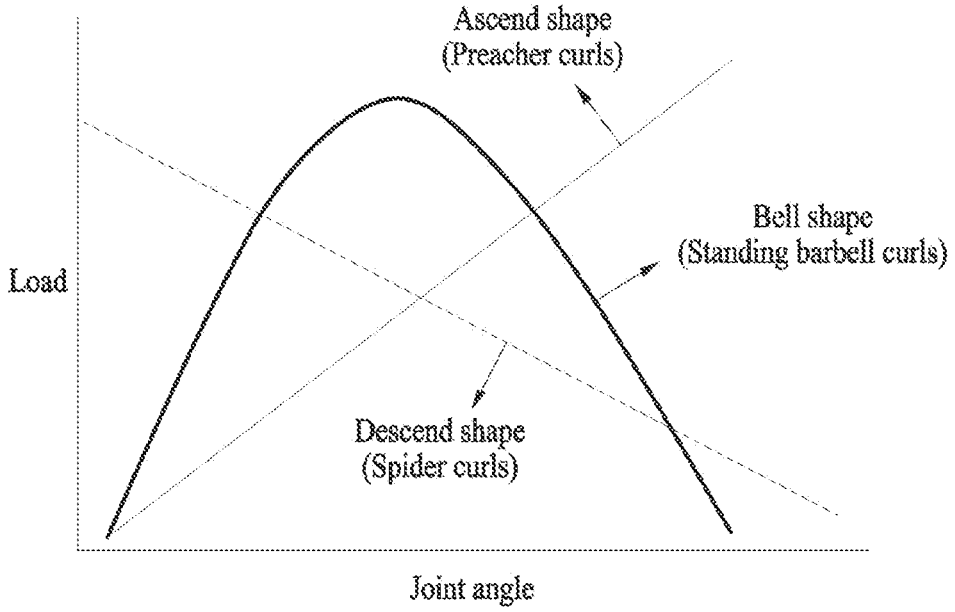
FIG. 22 is a graph illustrating the magnitude of a load for a joint angle of a user according to an example embodiment.

FIG. 22 is a graph illustrating the magnitude of a load for a joint angle of the user according to an embodiment.

Referring to FIG. 22, the fitness apparatus may adjust the magnitude of a load applied according to a change in the joint angle of the user. Even when the user performs an exercise to stimulate the same part of muscles, the magnitude of the load transmitted to the muscles may vary depending on the posture of the exercise. For example, standing barbell curl, preacher curl, and spider curl exercises may all be an exercise that stimulates the biceps.

When performing the standing barbell curl exercise by moving the arms while standing upright, the same effect as performing the spider curl exercise by moving the arms while bending the upper body may be obtained by adjusting the magnitude of the load according to the joint angle. For example, when the joint angle of the user is $\theta_1$, the joint angle measured by the IMU sensor may be provided to the high level controller and the high level controller may select a control gain. The driving module may be controlled in real-time by unwinding an elastic cable by the low level controller and the magnitude of force applied to a wearing part may be reduced. The user may exercise with a preferred exercise posture without being limited by space and exercise equipment.

According to an embodiment, a wearable fitness apparatus using an elastic cable may include a base plate to be worn on the back of the user, a wearing band connected, directly or indirectly, to the base plate, a driving module including a module case provided to the base plate to be detachable, a motor disposed inside the module case, an inelastic cable connected, directly or indirectly, to the motor, an elastic cable connected, directly or indirectly, to the inelastic cable, and a wearing part to be worn on the body of the user and connected, directly or indirectly, to the elastic cable. The elastic cable may have a length that changes when the inelastic cable is moved by the motor. "On" as used herein covers both directly on, and indirectly on with intervening element(s) therebetween.

Each embodiment herein may be used in combination with any other embodiment(s) described herein.

In an embodiment, the module case may be provided on the base plate to be position-adjustable.

In an embodiment, the module case may be provided along the base plate to be slidable.

In an embodiment, the module case may include a plate body disposed on the back of the user and a plate guide formed on the plate body and configured to guide sliding of the module case.

In an embodiment, the module case may be provided with respect to the base plate to be relatively rotatable.

In an embodiment, the length of the elastic cable may change while the module case rotates with respect to the base plate.

In an embodiment, the driving module may further include a controller configured to control an actuator.

In an embodiment, the fitness apparatus may further include a plurality of body sensors disposed on a wearing part, configured to sense a state of the user, and configured to transmit a sensed signal to the controller.

In an embodiment, the controller may control the motor based on information received from the plurality of body sensors.

In an embodiment, the controller may adjust tension applied to an elastic cable based on the information received from the plurality of body sensors.

In an embodiment, the plurality of body sensors may include a BPM measurement sensor to measure the BPM of the user.

In an embodiment, the driving module may further include a tension measurement sensor that may measure the tension applied to an elastic cable.

In an embodiment, the controller may control the motor based on information received from the plurality of body sensors and the tension measurement sensor. "Based on" as used herein covers based at least on.

In an embodiment, an inelastic cable may be wound around the motor as the motor rotates.

In an embodiment, an inelastic cable may be provided along the motor to be slidable.

Although the examples have been described with reference to the limited drawings, one of ordinary skill in the art may apply various technical modifications and variations based thereon. For example, suitable results may be achieved if the described techniques are performed in a different order, and/or if components in a described system, architecture, device, or circuit are combined in a different manner, or replaced or supplemented by other components or their equivalents. While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

Therefore, other implementations, other embodiments, and/or equivalents of the claims are within the scope of the following claims.

What is claimed is:

1. A wearable fitness apparatus comprising:

a base plate configured to be worn at least on a back of a user;

a driving module, comprising a module case and a motor, the motor disposed inside the module case, the module case detachably connectable to the base plate, and, while attached, translatable along and rotatable relative to the base plate;

a cable pair including an inelastic cable driven by the motor and an elastic cable;

a wearing part configured to be worn on at least a limb of the user, the wearing part being connected to the cable pair, wherein the elastic cable is connected in series between the inelastic cable and the wearing part;

a plurality of sensors including at least an inertial measurement unit, a pulse sensor, and a tension sensor configured to sense a state of the user and measure tension applied to the elastic cable; and a controller, comprising processing circuitry, configured to identify a type of an exercise performed by the user based on information regarding the sensed state and information regarding the measured tension, and to perform force feedback control of the motor so that tension in the elastic cable follows a selected load profile corresponding to the identified type of the exercise.

2. The wearable fitness apparatus of claim 1, wherein the module case comprises:

a plate body disposed on the back of the user; and a plate guide configured to guide sliding of the module case relative to the plate body.

3. The wearable fitness apparatus of claim 1, wherein the module case is rotatable with respect to the base plate.

4. The wearable fitness apparatus of claim 3, wherein the elastic cable has a length configured to change when the module case rotates with respect to the base plate.

5. The wearable fitness apparatus of claim 3, further comprising:

a high level controller, comprising circuitry, configured to receive a signal sensed from the sensors; and a lower-level controller, comprising circuitry, configured to receive the signal from the high level controller and control the motor.

6. The wearable fitness apparatus of claim 3, wherein the driving module further comprises a tension measurement sensor configured to measure tension applied to the elastic cable.

7. The wearable fitness apparatus of claim 6, wherein the controller is configured to control the motor based on information received from a plurality of body sensors and the tension measurement sensor.

8. The wearable fitness apparatus of claim 3, wherein the inelastic cable is configured to be wound around the motor as the motor rotates.

9. The wearable fitness apparatus of claim 3, wherein the inelastic cable is configured to be slidable.

10. The wearable fitness apparatus of claim 3, wherein the elastic cable is configured to have a length that changes when the inelastic cable is moved by the motor.

11. The wearable fitness apparatus of claim 1, further comprising:

the pulse sensor is configured to measure a BPM of the user.

12. The wearable fitness apparatus of claim 1, further comprising:

a wearing band connected to the base plate and configured to at least partially surround a part of the body of the user.

13. A wearable fitness apparatus comprising:

a base plate configured to be worn at least on a back of a user;

a driving module comprising a module case and a motor, the motor disposed inside the module case, the module case detachably connectable to the base plate and, while attached, translatable along and rotatable relative to the base plate;

a cable pair including an inelastic cable driven by the motor and an elastic cable;

a wearing part, comprising a band and/or strap, configured to be worn on at least a limb of the user, wherein the wearing part is connected to the elastic cable and is connected in series between the inelastic cable and the wearing part;

a plurality of sensors including at least an inertial measurement unit, a pulse sensor, and a tension sensor configured to sense a state of the user and measure tension applied to the elastic cable; and a controller, comprising processing circuitry, configured to identify a type of an exercise performed by the user based on information regarding the sensed state and information regarding the measured tension, and to perform force feedback control of the motor so that tension in the elastic cable follows a selected load profile corresponding to the identified type of the exercise.

14. A method of operating a wearable fitness apparatus comprising a motor disposed in a module case detachably connectable to a base plate worn on a back of a user, an inelastic cable driven by the motor and an elastic cable, a wearing part comprising a band and/or strap worn on at least a limb of the user, wherein the elastic cable is connected in series between the inelastic cable and the wearing part, and a plurality of sensors configured to sense a state of the user and measure tension applied to the elastic cable, the method comprising:

identifying a type of an exercise performed by the user based on information regarding the sensed state and information regarding the measured tension, and controlling the motor to adjust tension in the elastic cable so that the user is provided with a load profile corresponding to the identified type of exercise.

* * * * *